US006861645B2

(12) United States Patent
Franzen

(10) Patent No.: US 6,861,645 B2
(45) Date of Patent: Mar. 1, 2005

(54) HIGH RESOLUTION METHOD FOR USING TIME-OF-FLIGHT MASS SPECTROMETERS WITH ORTHOGONAL ION INJECTION

(75) Inventor: Jochen Franzen, Bremen (DE)

(73) Assignee: Bruker Daltonik, GmbH, Bremen (DE)

( * ) Notice: Subject to any disclaimer, the term of this patent is extended or adjusted under 35 U.S.C. 154(b) by 0 days.

(21) Appl. No.: 10/685,332

(22) Filed: Oct. 14, 2003

(65) Prior Publication Data

US 2004/0164239 A1 Aug. 26, 2004

(30) Foreign Application Priority Data

Oct. 14, 2002 (DE) ..... 102 47 895

(51) Int. Cl.[7] ..... H01J 49/40
(52) U.S. Cl. ..... 250/282; 250/287; 250/283
(58) Field of Search ..... 250/282, 283, 250/286, 287

(56) References Cited

U.S. PATENT DOCUMENTS 5,396,065 A * 3/1995 Myerholtz et al. ..... 250/287
6,285,027 B1 9/2001 Chernushevich et al.
6,373,052 B1 4/2002 Hoyes et al.
6,765,199 B2 * 7/2004 Youngquist et al. ..... 250/287
2003/0218129 A1 * 11/2003 Rather ..... 250/282

FOREIGN PATENT DOCUMENTS

| | | |
|---|---|---|
| GB | 2 390 936 A | 1/2004 |
| GB | 0323994-4 | 4/2004 |
| WO | WO 95/00236 A1 | 1/1995 |

* cited by examiner

*Primary Examiner*—Jack I. Berman

(57) ABSTRACT

The invention relates to a time-of-flight mass spectrometer in which a fine beam of ions is injected orthogonally into a fast pulser that pulses the ions from the fine ion beam into the spectrometer's drift region for precise determination of mass. The invention consists in increasing the duty cycle of the ions through the use of a high pulser frequency, recording the data cyclically at the same frequency, and assigning slow ions that are only measured in one of the subsequent cycles to the correct initiating pulse through the form of their lines or line patterns.

7 Claims, 2 Drawing Sheets

HIGH RESOLUTION METHOD FOR USING TIME-OF-FLIGHT MASS SPECTROMETERS WITH ORTHOGONAL ION INJECTION

FIELD OF THE INVENTION

The invention relates to a time-of-flight mass spectrometer for the precise determination of mass, in which a fine beam of ions is injected orthogonally into a fast pulser that pulses the ions in one section of the ion beam into the spectrometer's drift region.

BACKGROUND OF THE INVENTION

The best choice of mass spectrometer for measuring the mass of large molecules, as undertaken particularly in biochemistry, is a time-of-flight mass spectrometer because it does not suffer from the limited mass range of other mass spectrometers. Time-of-flight mass spectrometers are frequently abbreviated to TOF or TOF-MS.

Two different types of time-of-flight mass spectrometer have been developed. The first type comprises time-of-flight mass spectrometers for measuring ions which are generated in pulses in a tiny volume and accelerated axially into the flight path, for example with ionization by matrix-assisted laser desorption, MALDI for short, a method of ionization suitable for ionizing large molecules.

The second type comprises time-of-flight mass spectrometers for the continuous injection of an ion beam, one section of which is ejected as a pulse in a "pulser" transversely to the direction of injection and forced to fly through the mass spectrometer as a linearly spread ion beam lying transverse to the direction of flight, as the schematic in FIG. 1 shows. A ribbon-shaped ion beam is therefore generated in which ions of the same type, i.e. with the same mass-to-charge ratio, form a transverse front. This second type of time-of-flight mass spectrometer is known for short as an "Orthogonal Time-of-Flight Mass Spectrometer" (OTOF); it is mainly used in conjunction with out-of-vacuum ionization. The most frequently used type of ionization is electrospray ionization (ESI). Electrospray ionization (ESI) is also suitable for ionizing large molecules. It is also possible to use other types of ionization, for example chemical ionization at atmospheric pressure (APCI), photoionization at atmospheric pressure (APPI) or matrix-assisted laser desorption at atmospheric pressure (AP-MALDI). Ions generated in-vacuum can also be used. Before they enter the OTOF, the ions can also be selected and fragmented in appropriate devices so that the fragments can be used to improve the characterization of the substances.

In this second type of time-of-flight mass spectrometer, a large number of spectra, each with relatively low ion counts, are generated by a very high number of pulses per unit of time (up to 20,000 pulses per second) in order to utilize the ions of the continuous ion beam as effectively as possible.

In devices that are nowadays commercially available, the scanning of the ion beams in these orthogonal time-of-flight mass spectrometers is carried out using what are referred to as channel plate secondary electron multipliers, whose individual pulses, triggered by the ions, are scanned by event counters with digitization of the event time (TDC: time to digital converter). This technique, however, only offers an extremely restricted dynamic measurement range, of the order of 1, and this can only be increased through summing a large number of individual spectra. The dynamic measurement range is defined as the ratio of the largest still undistorted signal recorded at the saturation limit to the smallest signal that can be distinguished from the background noise. Because of the restricted dynamic range of this TDC technology, newly developed equipment is now using fast transient recorders. The fast transient recorders digitize the amplified ion beams at a rate of between 1 and 4 gigahertz in analog-to-digital converters with a signal resolution of up to eight bits. This already gives the individual spectrum a dynamic measurement range of around 50; here again, however, a large number of individual spectra are added in order to reach higher dynamic measurement ranges.

Using a TDC, a spectrum with a dynamic range of 20,000 is achieved in one second, operating at 20,000 pulses per second. If, on the other hand, an ADC is used, the dynamic range rises to about 1,000,000. The use of ADCs, however, slightly reduces the mass resolution if good focusing achieves an ion beam signal width of about two nanoseconds.

As with all mass spectrometers, with a time-of-flight mass spectrometer one can only determine the ratio of the mass m of the ion to the number z of elementary charges which the ion carries. Any subsequent reference to "specific mass" or quite simply to "mass" on its own always means the ratio m/z. If, by way of exception, "mass" in the following text is to be taken to mean the physical dimension of the mass, it will be specifically called molecular mass. The unit of molecular mass m is the unified atomic mass unit, abbreviated to u, usually simply termed "mass unit" or "atomic mass unit". In biochemistry and molecular biology, the essentially obsolete unit the dalton ("Da") is frequently used. The unit of specific mass m/z is "mass unit per elementary charge" or "dalton per elementary charge".

Electrospraying creates ions whose specific mass, m/z, hardly ever exceeds a value of around 5000 atomic mass units per elementary charge. This does not mean that only ions of molecules whose molecular weight does not exceed 5000 mass units can be ionized; molecules of larger mass are simply more frequently charged so that their specific mass, m/z, falls within this range. Ions of a molecule with 50 kilodaltons have a wide distribution of charge, z, extending from about 10 to 50 elementary charge units.

In a time-of-flight mass spectrometer having orthogonal ion injection, the ions in the pulser are accelerated transverse to the direction of their injection (the x-direction), and leave the pulser through openings in slit diaphragms. We refer to the direction of acceleration as the y-direction. After the acceleration, however, the ions are travelling in a direction in between the y-direction and the x-direction, because their original velocity in the x-direction is fully retained. The angle to the y-direction is given by $a=\arctan\sqrt{E_x/E_y}$), where $E_x$ is the kinetic energy of the ions in the primary beam in the x-direction, and $E_y$ the energy of the ions following their acceleration in the y-direction. The direction in which the ions are flying after being pulsed out is independent of the mass of the ions.

The ions that have left the pulser then form a wide ribbon, in which ions of one type (one specific mass, m/z) each form a front that has the width of the beam in the pulser. Light ions fly faster, heavy ions fly more slowly, but all in the same direction, ignoring slight differences in direction that can arise as a result of slightly differing kinetic energies, $E_x$, of the ions as they are injected into the pulser. The field-free flight path must be entirely surrounded by the acceleration potential so that the flight of the ions is not disturbed.

Ions with the same specific mass which are at different locations of the beam cross section, and which therefore have different flight distances in front of them before reaching the detector, can be time-focused in reference to their different start locations. This is done by arranging that when the outpulsing voltage is switched on, the field in the pulser is selected so that the ions furthest away are given a somewhat higher acceleration energy, enabling them to catch up with the leading ions at a starting location focus point. The position of the starting location focus point can be freely selected through the outpulse field strength in the pulser.

In order to achieve a high resolution, the mass spectrometer is fitted with an energy-focusing reflector, which reflects the ion beam that has been pulsed out, across its whole width, toward the ion detector, thus giving ions of the same mass but with slightly different initial kinetic energies in the y-direction an accurate time-focus on the large-area detector. It is also possible for multiple reflectors to be used.

The ions fly away from the (last) reflector toward the detector, which must be as wide as the ion beam in order to be able to measure all the ions that arrive. This detector must also be aligned parallel to the x-direction, so that the front formed by flying ions of the same mass are detected at the same time.

Normally, a continuous beam of ions in the form of a fine ion beam is injected in the x-direction into the pulser. The ion velocity in the x-direction is then not changed, in spite of the perpendicular deflection. Following the lateral deflection in the y-direction and reflection in the reflector, the ions therefore reach the detector in the same time that they would have required to fly straight to the detector without the lateral deflection in the pulser (although they would not in fact then meet the detector, as they would be flying parallel to its surface).

Refilling the pulser after it has been emptied begins immediately after the ions have left the pulser. When the ions of the heaviest mass have flown far enough to have arrived at the detector, had the passage to the detector been free, then not only is the pulser full of the heaviest ions again, but the space between the pulser and the detector is also filled with ions. However, only those ions that are located in the pulser at the time of the next ejection pulse can be detected. The ions in the intermediate space between the pulser and the detector are lost for the purposes of analysis. It can be seen from this that, to achieve a high duty cycle for the ion beam, it is necessary to choose the geometry of the time-of-flight mass spectrometer in such a way that the detector is as close as possible to the pulser (with parallel reflection and detection: there are also other geometric arrangements).

The resolution, R, and the mass accuracy of a time-of-flight mass spectrometer are proportional to the flight distance. It is therefore possible to increase the resolution by providing a very long flight tube, or by introducing multiple reflections using several reflectors. It is possible, for instance, with a flight path of one and a half meters, to achieve a mass resolution of about $R=m/\Delta m=10{,}000$, and with around six meters a mass resolution of $R=m/\Delta m=40{,}000$ (where $\Delta m$ is the line width of the ion signal at half maximum, measured in mass units). A long flight path, however, means that the pulse rate must be reduced to allow all the ions to reach the detector before the next pulse takes place. This, in turn, means that only a few ions in the ion beam are used for the measurement.

One known solution for achieving a high duty cycle of the ions together with the high resolution provided by a long flight path is intermediate storage of the ions in a storage ion guide, such as a guide hexapole. Intermediate storage in a quadruple, which can also be used for selection and fragmentation, is described in U.S. Pat. No. 6,285,027 B1 (I. Chernushevich and B. Thomson). Known methods can be used to store the ions here, and they are then driven out as required in order to fill the pulser. The disadvantage of this solution, however, is that the dynamic range of the measurements is greatly reduced. The fast transient recorders used nowadays, operating at one, two or four gigahertz, have an analog to digital converter with only eight bits of signal resolution, i.e. 256 counts, and the high data digitization rate restricts the signal resolution to between 5 and 7 bits. The dynamic range of the measurements of a single spectrum is therefore only roughly in the order of 50, in particular since the individual ions have to achieve at least a few counts in order to be detected above the noise. The saturation limit must not be exceeded in any of the individual spectra. A high dynamic range for the measurements can thus only be achieved by adding a large number of spectra. At least 2000 spectra must, for instance, be added together if a dynamic measurement range of 100,000 is desired, as is easily supplied by other types of mass spectrometry. If, however, the number of spectra per unit of time is reduced for high resolution, then the dynamic measurement range is also reduced to the same extent. If, instead of the analog to digital converters (ADC) mentioned here, only event time to digital converters (TDC) are used, as is usual in current commercial OTOFs, then another one or two orders of magnitude are lost from the dynamic measurement range, and this must be compensated for by adding a larger number of spectra together.

An insoluble dilemma is thus created: high mass resolution achieved by a long flight path means that an OTOF constructed according to conventional technology will always have either a low sensitivity or a low dynamic measurement range.

SUMMARY OF THE INVENTION

The present invention exploits a high proportion of the ions in the ion beam and achieves a high dynamic measurement range at the same time as a high resolution. The invention involves increasing the duty cycle of the ions through the use of a high pulser frequency without regard to the flight-time of the ions, recording the data cyclically at the same frequency, and assigning slow ions that are only measured in one of the subsequent cycles to the correct initiating pulse through the form of their lines or line patterns.

The fundamental idea of the invention is to allow the measuring equipment (that is the TDC, including its control electronics and its digital memory or the transient recorder with its ADC and memory) of a high resolution time-of-flight mass spectrometer with orthogonal ion injection to run without any pauses, to carry out cumulative storage of the measured values, without regard to the flight time of the ions, cyclically with a high cycle frequency in one section of the data memory, to pulse out the ion beam synchronously at the start of each cycle (thus distributing and scanning the spectrum of the ions over a number of measurement cycles), and to determine the association of the ions with a specific start pulse (to "their" start pulse) through the form of the ion signal or the form of a group of ion signals generated by the isotopy. Knowing the association with the nth measurement cycle following the start pulse, the precise time of flight can be calculated, and from the time of flight the specific mass, m/z, can be precisely determined. To avoid jitter it is favorable for the measuring equipment to drive the pulser in exact synchronism with the storage cycles.

The width of the ion signals, measured as the half-height signal width of the flight time, $\Delta t$, rises, in theory, linearly with the time of flight: $\Delta t=t/2R$, where R is the mass resolution, $R=m/\Delta m$, theoretically constant across the spectrum. In practice, however, there is a further constant time (combined under Pythagorean addition) that arises from a widening of the signal in the detector, and which is particularly noticeable in the case of light, and therefore fast, ions. There is a clear relationship between the signal width and the specific mass, and this can be used for rough determination of the mass. The signal width, $\Delta t$, can be determined for signals that are well above the background noise to an accuracy of 5% (or better); this makes it very easy to determine whether an ion reached the detector in the first, second, third or even higher measurement cycle following the start pulse. This, in turn, yields the precise time of flight, and therefore the precise specific mass of the ions.

There is, however, a second method of determining the approximate mass. This method exploits the isotopy of the ions. For organic ions that do not contain any halogens (all biological molecules, for instance), the distribution of the various isotopic masses of a molecule is, in practical terms, determined only by the isotopy of the carbon. The isotope distribution pattern of a group of lines allows the molecular masses of the ions to be approximately estimated, following rules that are known to the specialist. The pattern can, however, be associated with singly or multiply charged ions; it is therefore also necessary to determine the charge on the ions before the specific mass of the ions can be found. The charge, however, can be determined from the spacing between the lines within the line group; if the spacing corresponds to a full unit of mass, then the ion has a single charge; if it corresponds to half a mass unit, then the ion has a double charge, and so on. For very high charges, such as occur when very heavy analyte molecules are subjected to electrospray ionization, a very high mass resolution must therefore be available so that these isotope lines can be separated from one another; this invention, however, is particularly appropriate for time-of-flight spectrometers with very high mass resolution.

However, the specific mass of ions with very heavy molecular masses, where the isotope group profile does not resolve different isotopes, can also be deduced using the width of the group signal. Analyzing the groups with different states of charge allows this mass to be further substantiated, since for very heavy molecules there is always a wide distribution of ions with many charge states: z, z+1, z+2, z+3 and so forth.

Another method for approximately determining the specific masses of the ions makes use of an analysis of the velocities of the ions arriving at the detector, for instance by having the detector only take a proportion of the ions from the ion beam, the remainder of the ions being measured in a second detector displaced along the flight path. A comparison of the spectra from the two detectors yields the velocity of the respective ions, from which the approximate specific mass can be determined immediately. The very high resolution only needs to be set for one of the two detectors.

If two or more signal groups in which the isotopes can be distinguished overlap, mathematical methods can be applied to resolve the overlap; this method, however, has its limits. The invention is particularly designed for spectra with high mass resolution in which only relatively few signal overlaps occur. To avoid an excessive number of overlaps, the invention requires relatively "clean" spectra, that is the spectra from ions derived from only a small number of simultaneously present substances. The invention is therefore ideal for high resolution scanning of substances that have been separated by prior separating procedures, such as liquid chromatography or capillary electrophoresis.

DETAILED DESCRIPTION

Figure 1:
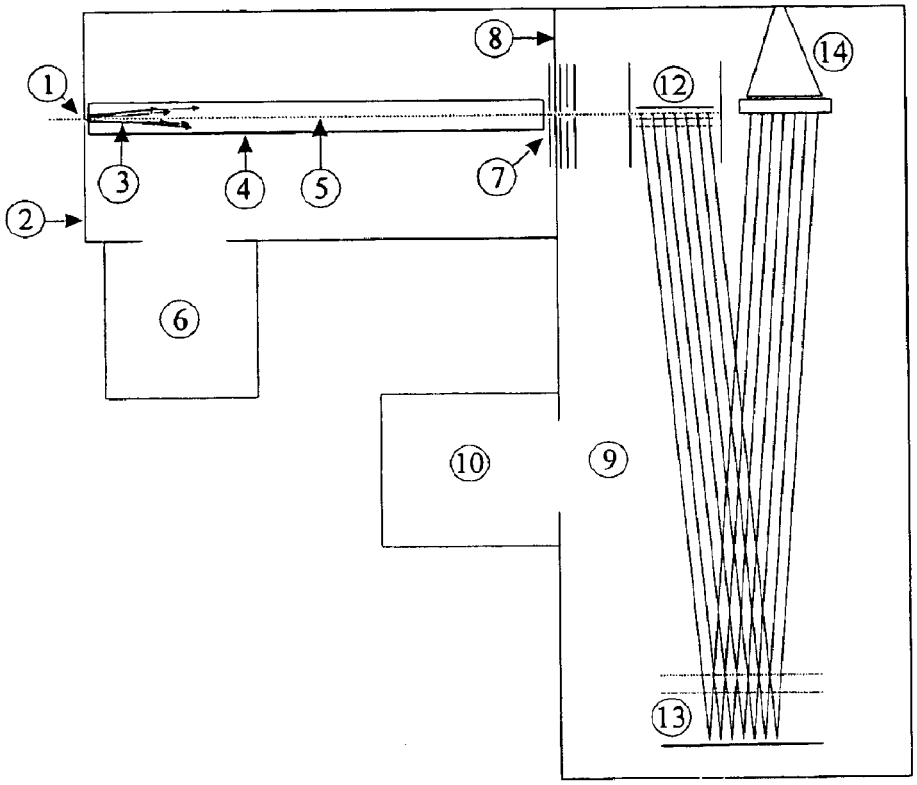
FIG. 1 is a schematic diagram of a time-of-flight mass spectrometer with orthogonal ion injection.

FIG. 1 is a schematic diagram of a time-of-flight mass spectrometer with orthogonal ion injection. A bundle (3) of ions with various initial energies and initial directions passes through an opening (1) in a vacuum chamber (2) and enters an ion guidance system (4) situated inside a gas-proof jacket. Damping gas enters the ion guidance system at the same time. The ions that enter are slowed by impacts with the gas. Because the ions in the ion guide system are subject to a pseudo-potential that is lowest at the axis (5), the ions accumulate at the axis (5). The ions spread out along the axis (5) as far as the end of the ion guide system (4). The gas in the ion guidance system is pumped out by the vacuum pump (6) attached to the vacuum chamber (2).

The drawing lens system (7) is located at the end of the ion guide system (4). An apertured diaphragm belonging to this drawing lens system is integrated into the wall (8) between the vacuum chamber (2) for the ion guidance system (4) and the vacuum chamber (9) for the time-of-flight mass spectrometer. This second chamber is evacuated by a vacuum pump (10). The drawing lens system (7) in this schematic diagram consists of five apertured diaphragms; it draws the ions out of the ion guide system (4) and forms a fine beam of ions with a small phase volume that is focused in the pulser (12). The beam of ions is injected into the pulser in the x-direction. When the pulser is filled with flying ions of the mass to be examined, a brief voltage pulse ejects a wide package of ions in the y-direction, transverse to the former direction of flight, forming a broad beam of ions that is reflected in a reflector (13) and measured with high time resolution by an ion detector (14). In the ion detector (14) the ion signal, which is amplified in a secondary electron amplifier in the form of a double multi-channel plate, is capacitively or transferred to a 50 Ω cone. The signal that has thus already been amplified is passed through a 50 Ω cable to an amplifier. The purpose of the 50 Ω cone is to terminate the cable at the input end, so that no signal reflections can take place here.

In this schematic diagram, the reflector (13) and the detector (14) are aligned exactly parallel to the x-direction of the ions injected into the pulser. The distance between the detector (14) and the pulser (12) determines the maximum level of exploitation of the ions in the fine ion beam.

As described above, the fundamental idea of the invention is to allow the measuring equipment of a high resolution time-of-flight mass spectrometer with orthogonal ion injection to run cyclically at a high cycle frequency without regard to the flight time of the ions, to pulse out the ion beam synchronously with the measurement cycles, and to determine the association of the ions with "their" start pulse through the form of the ion current signal or the form of a group of ion current signals. Knowing the association with the nth measurement cycle after the start pulse, the precise time of flight can be calculated, and from the time of flight the specific mass, m/z, can be determined precisely.

Since the measuring equipment includes its own control clock, it is favorable, in order to avoid jitter, for the pulser to be driven by the measuring equipment itself synchronously with the measurement cycles, rather than using an external clock to control the measuring equipment and the pulser.

The invention is particularly effective in the context of high resolution and very high resolution time-of-flight mass spectrometry, because in those cases the ion signals are narrow and widely separated. Ion signals hardly ever overlap, in particular when spectroscopy is preceded by substance separation through, for instance, liquid chromatography or capillary electrophoresis.

Usually a previously specified, large number of measurement cycles are carried out, until, for instance, a time of one tenth of a second has elapsed. In this way, 10 cumulative spectra are obtained each second, and with a measurement cycle rate of 20 kilohertz these each incorporate 2000 individual spectra. The measurements from the cycles are stored cumulatively, and determination of the form of the ion current signals or of the ion current signal group, that is the isotope group, is carried out on the cumulative spectra obtained in this way. The dynamic measurement range is 100,000 in each cumulative spectrum.

Figure 2:
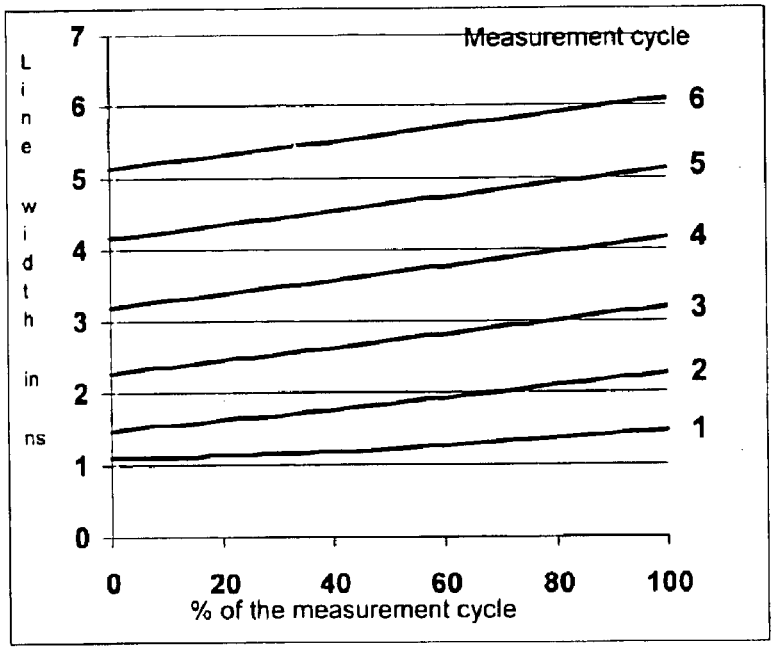
FIG. 2 is a graphical illustration showing the increase in line widths for ion signals that are measured in the first measurement cycle or, after one, two or n passages of the measurement cycle time, in the succeeding measurement cycle.

FIG. 2 illustrates the increase in the line widths for ion signals that are measured in the first measurement cycle or, after one, two or n passages of the measurement cycle time, in the succeeding measurement cycle. The line widths, Δt, are measured at half the maximum height of the ion current signals, and are represented here for a resolution of R=20,000 in nanoseconds. From this diagram it is possible to determine immediately, from the measured line width, for how many measurement cycles the ion has already been in passage in the time-of-flight mass spectrometer. From this knowledge it is then possible to determine immediately the precise time of flight since the associated start pulse, and from this to find the precise mass of the ions.

The simplest method of determining the approximate specific mass for an ion current signal is to take the half-value width, Δt, of this ion current signal. As illustrated in FIG. 2, there is an unambiguous relationship between the width of the signal and the specific mass, and this can be used in a very simple way for an approximate determination of the mass. The signal width, Δt, can be determined for signals that are well above the background noise to an accuracy of 5% (or better). This makes it very easy to determine whether a particular type of ion reached the detector in the first, second, third or even higher measurement cycle following the start pulse. This, in turn, yields the precise time of flight, and therefore the precise specific mass of the ions.

It is thus possible with, for instance, a flight length of six meters (which can be created either through a long flight tube or through multiple reflections, or even with the aid of circular trajectories) and an acceleration voltage of 10 kilovolts, to obtain a resolution of approximately R=40,000. Ions with a specific mass of 200 daltons per elementary charge reach the ion detector after 64 microseconds. If a transient recorder with a conversion rate of four gigahertz is used, then this corresponds to $2^{18}$~256 000 measurements in 64 microseconds. Cyclical storage can be achieved very effectively using memory address regions that match complete powers of two. It is thus particularly effective to set up a measurement cycle, in accordance with the invention, of 64 microseconds using $2^{18}$ memory cells. The theoretical half-value width for the ion signal of the specific mass of 200 daltons per elementary charge is then Δt=0.8 nanoseconds; the line width is, however, larger because of the additive detector time, as is shown in FIG. 2. The cycle frequency is then 15.625 kilohertz. A cumulative spectrum obtained over a scanning period of one tenth of a second then contains 1562 individual spectra in the same number of measurement cycles, although the spectra each relate to a number of cycles. If a dynamic measurement range of 60 is assumed for an individual spectrum, then the total dynamic range of the measurements is almost $10^5$ for a spectrum scanned over one tenth of a second, which is a very satisfactory value.

As a further example, it would be possible to operate a mass spectrometer with a four meter flight path, a two gigahertz transient recorder, an acceleration voltage of 18 kilovolts and a scanning cycle of 31.25 kilohertz. The spectrum then only consists of $2^{16}$~64,000 measurements. The dynamic measurement range is higher still here, but the mass resolution, on the other hand, is lower.

The isotopic distribution of organic molecules represents a second method of determining the approximate mass. If organic ions do not contain halogens, as is, for instance, the case for all biological molecules, the distribution over the various isotopic masses of a molecule is almost exclusively determined by the isotopic distribution of carbon. The isotopic structure of carbon forms characteristic patterns of isotopes for large organic molecules, from which molecular mass can be approximately determined.

Figure 3:
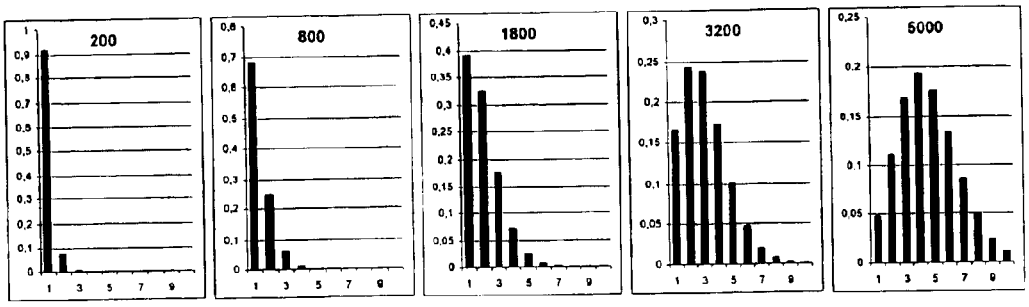
FIG. 3 is a graphical illustration showing the isotope pattern of singly charged ions at the end of the first, second or nth measurement cycle.

FIG. 3 illustrates the isotopic distributions for singly charged ions, whose mass yields flight times such that they arrive at the ion detector at the end of the first, second, third, fourth and fifth measurement cycles respectively. The flight length of the spectrometer has been selected here to be long enough so that, at the end of the first measurement cycle, ions with a specific mass of 200 atomic mass units per elementary charge reach the detector. At the end of the second measurement cycle, ions with a mass of 800 mass units then arrive; after the third measurement cycle, ions with a mass of 1800 mass units, then ions with 3200 mass units and finally, after the fifth measurement cycle, ions with a mass of 5000 mass units per elementary charge. These figures reflect the quadratic relationship of the mass and the time of flight; they represent 200 daltons multiplied respectively by one, four, nine, sixteen and twenty-five. The isotope patterns allow the approximate molecular mass to be determined immediately. For ions with multiple charges, i.e., ions with a different specific mass, the same isotope pattern of course occurs. To determine the specific mass it is therefore also necessary to refer to the spacing of the signal lines within the isotope group.

The isotope distribution pattern measured for a group of lines thus also allows the molecular mass of the ions to be roughly determined. The pattern can, however, be associated with ions having a single or multiple charge; it is therefore also necessary to determine the charge of the ions before their specific mass can be determined. The charge can, however, be found from the distance between the lines within the line group: if the distance corresponds to one complete mass unit, then singly charged ions are involved:

if it corresponds to half a mass unit, the ions have a double charge, and so forth.

In addition to analysis of the single signals and analysis of the isotope group signals, there is a third method of roughly determining the specific masses of the ions, namely through analysis of the velocity of the ions arriving at the detector. This can, for instance, be carried out using the spectra from a double detector. If one detector takes only some of the ions from the ion beam, allowing the remaining ions to reach a second detector displaced along the flight path, then a comparison of the spectra from the two detectors allows the velocity of the relevant ions to be determined. From the velocity, the specific mass can be estimated sufficiently well to assign the ions to one of the foregoing pulses. The very high resolution here only needs to be set on one of the two detectors.

As electrospraying hardly generates any ions with a specific mass greater than 5000 daltons per elementary charge, calibration of the ion current signal widths beyond the ranges illustrated in FIG. 3 is scarcely necessary, but can be easily done. For high levels of charge, such as occur as a result of the electrospray ionization of heavy analyte molecules, a very high mass resolution is necessary in order for these isotope lines to be separated from one another. This invention, however, is tailored precisely to time-of-flight spectrometers with very high mass resolution.

Figure 4:
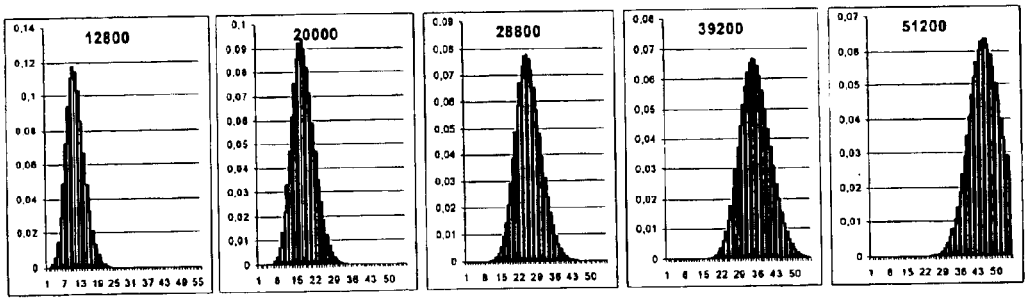
FIG. 4 is a graphical illustration showing the widening of the isotope group as the molecular mass rises.

Even for ions with very heavy molecular masses, where the isotope group profile does not resolve different isotopes, it is still possible to deduce the specific mass from the width of the signal, as can be seen in FIG. 4. FIG. 4 illustrates the widening of the isotope group as the molecular mass rises. As this isotope group is given multiple charges, the width of the isotope group decreases correspondingly; and the width is thus a direct indicator of the specific mass of the ions. It is possible to prepare a calibration curve for the width of the isotope groups, similar to the calibration curve shown in FIG. 2 for single signal widths A mass that has been determined approximately in this way can be further substantiated by analyzing the groups with different charge states, since a wide distribution of ions with many different charge states is always present for very heavy molecules. Using the patterns associated with different charge states, taking into account the rising number of protons with higher charge states, is a method of mass determination familiar to the specialist.

If signal groups overlap, mathematical methods can be applied to resolve the overlap. This method, however, has its limits. The invention is particularly designed for spectra with high mass resolution in which only relatively few signal overlaps occur in the signals. To avoid an excessive number of overlaps, the invention requires relatively "clean" spectra, that is spectra from ions derived from a small number of simultaneously present substances. The invention is thus ideal for high resolution scanning of substances that have been subject to previous separation processes such as liquid chromatography or capillary electrophoresis.

Cyclic scanning in accordance with this invention assumes that no interference signals are transmitted from the pulser to the detector. In practice, this is difficult to achieve, and for spectrometers operating according to prior methods it is not of great significance unless the extremely light ions are also to be measured. To ensure that cross-coupling does not take place, both the pulser and the detector must be as well screened as possible. In orthogonal time-of-flight mass spectrometers constructed as in the past, this is difficult to achieve because, as can also be seen in FIG. 1, the pulser and the detector are located close to one another. For high resolution mass spectrometers with long flight paths, however, the pulser and the detector can be located a considerable distance apart through the appropriate use of reflectors, so that the problem is also solved electronically. Weak residual cross-coupling can also be cancelled out of the sum spectra in known ways.

What is claimed is:

1. A method for the precise mass determination of ions in a time-of-flight mass spectrometer that uses orthogonal ion injection and has a pulser, an ion detector and a measuring device for measuring ion currents at the detector, the method comprising:

(a) measuring, with the measuring device, ion current signals at the detector cyclically without regard to the passage time of the ions and accumulates the results in a store;

(b) pulsing out ions in the pulser synchronously with the measuring cycles;

(c) determining an association of the measured ion current signals with ion pulses using at least one of the shape of the ion current signal, the shape of the ion current signal group, and the velocity of the ions; and (d) determining, using said association of ion current signals to said ion pulses, flight times and specific masses of the ions.

2. A method according to claim 1, wherein the association of the measured ion current signals with one of the foregoing pulses is determined using a width of the ion current signal.

3. A method according to claim 1, wherein the association of the measured ion current signals with one of the foregoing pulses is determined using an isotopic distribution in the ion current signal group and through the distances between the ion current signals within the ion current signal group.

4. A method according to claim 1, wherein the association of the measured ion current signals with one of the foregoing pulses is determined using a width of the ion current signal group and through the pattern of the ion current signal groups of various charge states.

5. A method according to claim 1, wherein the association of the measured ion current signals with one of the foregoing pulses is determined using an analysis of the velocity of the ions.

6. A method according to claim 5, wherein the analysis of the velocities is performed using two spectra, the two spectra being obtained using two detectors for which the flight paths of the ions have different lengths.

7. A method according to claim 1, wherein the pulser of the time-of-flight mass spectrometer is controlled by the measuring device.

* * * * *